United States Patent [19]

Berwick et al.

[11] Patent Number: 5,032,481

[45] Date of Patent: Jul. 16, 1991

[54] PHOTOCONDUCTOR ELEMENTS WITH MULTIPHASE STRESS-DAMPENING INTERLAYERS

[75] Inventors: Martin A. Berwick, Kendall; William T. Gruenbaum; Paul D. VanderValk, both of Rochester, all of N.Y.

[73] Assignee: Eastman Kodak Company, Rochester, N.Y.

[21] Appl. No.: 429,951

[22] Filed: Oct. 30, 1989

[51] Int. Cl.[5] ..... G03G 5/14

[52] U.S. Cl. ..... 430/60; 430/96

[58] Field of Search ..... 430/59, 60, 96

[56] References Cited

U.S. PATENT DOCUMENTS 4,346,158 8/1982 Pai et al. ..... 430/59

*Primary Examiner*—John Goodrow

*Attorney, Agent, or Firm*—Dressler, Goldsmith, Shore, Sutker & Milnamow, Ltd.

[57] ABSTRACT

An improved interlayer is provided for use in a photoconductor element between an electrically conductive layer and a charge generation layer of the type where a dye is aggregated in a matrix polymer. The interlayer is a mixture of at least one polyester and at least one polycarbonate. The interlayer provides excellent adhesion between the conductive layer and the charge generation layer and dampens any stress to which the photoconductive element is subjected. Minimal effect on photosensitivity is achieved by optimizing interlayer thickness.

6 Claims, No Drawings

PHOTOCONDUCTOR ELEMENTS WITH MULTIPHASE STRESS-DAMPENING INTERLAYERS

FIELD OF THE INVENTION

This invention is in the field of photoconductor elements having an interlayer between the electrically conductive layer and the charge generation layer.

BACKGROUND OF THE INVENTION

Photoconductor elements having a variety of interlayers positioned between a conductive layer and a photoconductive layer are well known. For example, interlayers have been used to bond organic photoconductive layers to electrically conductive layers.

However, photoconductive and conductive layers used in multiactive elements such as described, for example, in U.S. Pat. No. 4,175,960, exhibit unique problems. The photoconductive layer is heterogeneous and both layers tend to be brittle. When the coated and dried layers are subjected to stress, these two layers work against each other so that the photoconductive layer tends to separate from the conductive layer as a result of the stresses produced by flexing this film during handling and/or use. Conventional interlayers positioned between these layers do not appear to be useful in such structures.

New interlayer structures are needed which dampen any stress to which the photoconductor element is subjected and which provide adhesion between the photoconductive layer and the electrically conductive layer. The interlayer structure must also be free of secondary chemical or electrical effects that could deleteriously effect the overall behavior of the element.

SUMMARY OF THE INVENTION

The invention is directed to a photoconductor element wherein an interlayer comprised of a mixture of at least one polyester and at least one polycarbonate is interposed between an electrically conductive layer and a charge generation layer of the type wherein a dye is aggregated and is a component of discontinuous crystalline complexes in a continuous polymeric matrix.

The interlayer provides excellent adhesion between the electrically conductive layer and the charge generation layer; the interlayer dampens any stress to which the photoconductor element is subjected. Minimal effect on photosensitivity is achieved by optimizing interlayer thickness.

The interlayer is electrically insulating and free of secondary chemical or electrical effects which could deleteriously effect overall photoconductor element behavior.

Surprisingly, the interlayer provides better properties than can be achieved by either the polyester or the polycarbonate when each is separately used as an interlayer. The interlayer has better properties than can be achieved by the use of any other known film forming polymeric material with electrical insulating characteristics.

Various other features, advantages, aims, purposes, embodiments and the like of this invention will be apparent to those skilled in the art from the present specifications and claims.

DETAILED DESCRIPTION OF THE INVENTION

Improved adhesion, particularly under, or as a result of, stress, of heterogeneous charge-generation to conductive layers is achieved in photoconductor elements by interposing an interlayer of the present invention between a charge-generation layer and a conductive layer. The charge-generation layer can optionally include a photoconductor.

The photoconductor elements of this invention can employ polymeric film or sheet materials as a non-conducting support layer. Presently preferred polymers include cellulose acetates, polystyrenes, polycarbonates, polyesters such as polyethylene terephthalate, and the like.

The support layer is associated with an electrically conductive layer. Various electrically conductive layers that are known in the photoconductor element art can be employed. For example, the conductive layer can be a metal foil which is conventionally laminated onto the support layer. Suitable metal foils include those comprised of aluminum, zinc, copper, and the like. Vacuum vapor deposited metal layers, such as silver, chromium, nickel, aluminum, alloys thereof, and the like are presently preferred. The thickness of a vapor deposited metal layer can be in the range of about 30 to about 2000 Angstroms. The conductive layer can also be comprised of particles of a conductor or semiconductor dispersed in a binder. For example, a conducting layer can be comprised of compositions of protective inorganic oxide and about 30 to about 70 weight percent of conductive metal particles such as a vapor deposited conductive cermet layer as described in U.S. Pat. No. 3,880,657. See also the teachings of U.S. Pat. No. 3,245,833 relating to conductive layers employed with barrier layers. Organic conductive layers can be employed, such as a layer comprised of a sodium salt of a carboxy ester lactone of maleic anhydride and a vinyl acetate polymer as taught in U.S. Pat. Nos. 3,007,901 and 3,262,807. If desired, the support layer and the conductive layer can be combined into a single structure. For example, metal plates can be used, such as those comprised of aluminum, copper, zinc, brass, galvanized metals, and the like.

An interlayer is coated over the conductive layer. The interlayer is comprised of a uniform mixture of a solvent soluble or colloidally dispersible polyester and a solvent soluble or colloidally dispersible polycarbonate. More than one polyester or polycarbonate can be used in a given interlayer. Preferably, the interlayer is comprised of a mixture of a polyester, as for example one disclosed in U.S. Pat. No. 4,284,699, having an inherent viscosity in the range of about 0.4 to about 0.8 measured as a 0.25 g/dL solution in 1:1 phenol:chlorobenzene at 25° C. and a polycarbonate having an inherent viscosity in the range of about 1.2 to about 2.0 measured as a 0.5 g/dL solution in dichloromethane at 25° C. The weight ratio of polyester to polycarbonate can range widely in such a mixture, but usually is in the range of about 25:1 to 1:25. In the preferred mixtures, the quantity of polyester is in the range of about 10 to about 90 weight percent, and more preferably is in the range of about 25 to about 75 weight percent, with the balance up to 100 weight percent thereof being comprised of polycarbonate. The glass transition temperature ($T_g$) of a mixture can range widely, but, in the preferred mixtures, the $T_g$ is above about 60° C.

The term "glass transition temperature" (or $T_g$) as used herein refers to the temperature at which a polymeric material changes from a glassy polymer to a rubbery polymer. This temperature ($T_g$) can be measured by differential thermal analysis as disclosed in "Techniques and Methods of Polymer Evaluation", Vol. 1, Marcel Dekker, Inc., N.Y. 1966.

Typically, the thickness of an interlayer is in the range of about 0.1 to about 1 micron, with thicknesses in the range of about 0.4 to about 0.6 being presently preferred. A presently most preferred thickness appears to be about 0.5 micron. In general, layers thinner than about 0.3 or 0.4 micron do not appear to offer optimal adhesion improvement compared to interlayers using either the polyester or the polycarbonate alone, while layers thicker than about 0.6 or 0.7 micron appear to deleteriously affect the photosensitivity of an element.

The polyesters and polycarbonates used in the interlayer can be known solvent soluble polymers or copolymers which are organic solvent soluble or which are colloidally dispensable in water. For example, the polyester may be an organic solvent soluble material of the type described in U.S. Pat. Nos. 3,517,071; 3,703,722; and 4,173,472, or it may be a water-dispersible polyester of the type described in U.S. Pat. Nos. 3,018,272; 3,563,942; 3,734,874; and 3,779,993. One presently preferred class of polyesters is described in U.S. Pat. No. 4,284,699.

The polycarbonate may be an organic solvent soluble material or a water-dispersible polycarbonate, such as a linear polymer having the structure:

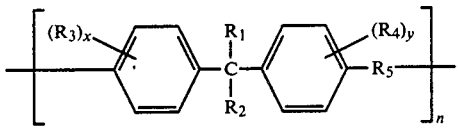

wherein:

$R_1$ and $R_2$ when taken separately can each be a hydrogen atom, an alkyl radical, a substituted alkyl radical, or a substituted aryl radical;

$R_1$ and $R_2$ when taken together can represent the carbon atoms necessary to form a cyclic hydrocarbon radical containing up to 19 carbon atoms;

$R_3$ and $R_4$ can each be a hydrogen atom, a lower alkyl radical, or a halogen atom;

$R_5$ is a divalent radical selected from

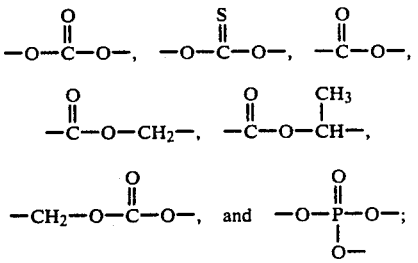

x and y each can be an integer of 1 to 4; and n is an integer of 700 to 1400.

Usually an alkyl radical contains less than 10 carbon atoms unless otherwise indicated. The term "lower" as used herein before a radical such as "alkyl" or the like means that such radical contains less than 6 carbon atoms. Examples of alkyl radicals include methyl, ethyl, propyl, isopropyl, butyl, tertiary butyl, pentyl, hexyl, heptyl, octyl, nonyl, decyl, and the like. Alkyl radicals can have straight or branched chains. Examples of substituted alkyl radicals include halo substituted radicals, such as chlorosubstituted and fluorosubstituted alkyl radicals, including trifluoromethyl and the like.

The term "aryl" as used herein means mono- or polycyclic hydrocarbon fused or nonfused ring systems that can contain one or more hetero atoms such as N, O or S in the ring system and can be unsubstituted or substituted.

Preferred aryl radicals are phenyl and preferred substituents include halo, lower alkyl and the like.

The term "halo" and the term "halogen atom" each include fluorine, chlorine, bromine, and iodine.

Presently preferred block polymeric units of formula (1) are those wherein $R_1$ and $R_2$ are $CH_3$, $R_3$ and $R_4$ are hydrogen, $R_5$ is

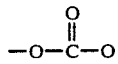

and n is about 1300

Among particularly useful polycarbonates are block polymeric units having the following structure:

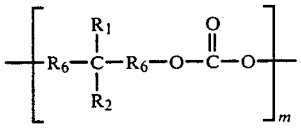

(2)

wherein:

$R_1$ and $R_2$ are as above defined in reference to formula (1);

$R_6$ is a divalent radical selected from phenylene radicals, halo substituted phenylene radicals, and lower alkyl substituted phenylene radicals; and m is an integer of 700 to 1400.

These polymers are disclosed, for example, in U.S. Pat. Nos. 3,615,414; 3,028,365; and 3,317,466. Presently preferred are polycarbonate units containing an alkylidene diarylene moiety in the recurring unit, such as those prepared with bisphenol A and including polymeric products of ester exchange between diphenylcarbonate and 2,2-bis(4-hydroxyphenyl)propane, sometimes herein termed bisphenol-A-polycarbonate. These polymers are disclosed, for example, in U.S. Pat. Nos. 2,999,750; 3,038,874; 3,038,879; 3,038,880; 3,106,544; 3,106,545: and 3,106,546: and published Australian Patent Specification No. 19575/56.

The interlayer is conveniently applied as an overcoating upon a conductive layer using an interlayer coating composition. In such a composition, the polyester and the polycarbonate are each dispersed and preferably dissolved in a solvent. Preferred solvents are volatile (that is, evaporable) at temperatures below about 100° C.

Examples of suitable solvents include aromatic hydrocarbons such as benzene, toluene, xylene, mesitylene, etc.; ketones such as acetone, 2-butanone, etc.; ethers such as cyclic ethers like tetrahydrofuran, methyl ethyl ether, petroleum ether, etc.; halogenated aliphatic hydrocarbons such as chloroform, methylene chloride, and ethylene chloride, etc.; alcohols, such as isopropyl alcohol, etc.; and the like. Presently preferred solvents are dichloromethane and 1,1,2-trichloroethane.

For purposes of coating efficiency, it is convenient to incorporate into a coating composition containing the polyester and the polycarbonate minor amounts of optional additives such as surfactants, levelers, plasticizers, and the like. A preferred additive is DC-510®, a siloxane from Dow Corning.

When additives are used, they are preferably dissolved in the coating solvent. The total amount of additives is usually under about 15 weight percent on a total solids basis.

In such an interlayer coating composition, the total solids content can vary, but is preferably in the range of about 1 to about 5 weight percent with the balance being solvent.

Such a coating composition is conveniently applied by using a technique such as knife coating, spray coating, spin coating, extrusion hopper coating, (presently preferred), or the like. After application, the coating is air dried.

A charge generating layer is applied over the interlayer. The charge generating layer is comprised of an electrically insulating polymer phase which has dispersed therein a discontinuous phase. The discontinuous phase comprises a finely-divided, particulate co-crystalline complex of:

(i) at least one polymer having an alkylidene diarylene group in a recurring unit; and (ii) at least one thiapyrylium-dye salt. Such charge generating layers are described for example in U.S. Pat. No. 4,175,960, the teachings of which are incorporated herein by reference.

Such a charge generating layer is adapted for use in combination with a charge-transport layer, as taught in the aforereferenced U.S. Pat. No. 4,175,960, in multiactive photoconductor elements.

When a photoconductor is in solid solution in the matrix phase, the charge generating layer may be employed in a single active layer photoconductor element as the high-speed heterogeneous or aggregate photoconductive layer, as taught in U.S. Pat. No. 3,615,414, the teachings of which are also incorporated herein by reference. In such a case, the matrix phase contains at least one organic photoconductor in solid solution.

The co-crystalline complexes or discontinuities have sizes in the range of about 0.01 to about 25 microns, and preferably about 0.1 to about 5 microns.

Typically, the charge generating layer is less than about 15 microns in thickness but more than about 0.5 microns in thickness, and preferably about 1 to about 10 microns in thickness.

Typically, the charge generating layer contains about 2 to about 10 weight percent of the thiapyrylium dye. If and when an organic photoconductor is present in the charge generating layer, the amount thereof can be in the range of about 20 to about 60 weight percent.

The charge generating layer is prepared as a coating solution which is applied over the interlayer. The preparation and coating of such a coating solution can be accomplished as described in aforereferenced U.S. Pat. Nos. 4,175,960 and 3,615,414.

When a charge transport layer is utilized in combination with a charge conducting layer, the charge transport layer is an organic composition having a dry thickness within the range of about 1 to 30 times, and preferably about 3 to about 10 times, that of the charge generating layer. The charge transport layer is free from co-crystalline complexes and any thiapyrylium-dye salts.

The charge transport layer preferably comprises a charge transport material or organic photoconductive material having a principal adsorption band below about 400 nm and capable of accepting and transporting injected charge carriers from the charge generation layer.

The invention is further illustrated by the following examples:

EXAMPLE 1

A multiactive element of the type described in U.S. Pat. No. 4,175,960 was utilized as a control (Example 1.1 in Table I). It contained a polyester sublayer of poly(ethylene:neopentylene terephthalate 55:45) as described in U.S. Pat. No. 4,284,699. The experimental coatings differed only in that the polyester sublayer was replaced by a series of mixed polyester/polycarbonate interlayers (Table 1). Each of the five polyester/polycarbonate weight ratio variations was prepared by dissolving the polymer (6.0 g total; ratios as listed in Table 1; polyester is poly(ethylene:neopentylene terephthalate 55:45); polycarbonate is a high molecular weight bisphenol-A-polycarbonate) in a mixture of dichloromethane (276 g) and 1,1,2-trichloroethane (118 g). Each interlayer variation was coated at two thicknesses (0.25 and 0.50 μm) with an extrusion hopper coater. The following results were obtained:

TABLE 1

| Example I.D. No. | Interlayer Polyester/ Polycarbonate weight ratio | Interlayer thickness (microns) | % Peel[1] stressed film | % Peel[1] unstressed film | 680 nm Exp. −500 V −100 V (ergs/cm$^2$) |
|---|---|---|---|---|---|
| 1.1 | 6/0 | 0.13 | 94 | 97.5 | 3.4 |
| 1.2 | 6/0 | 0.25 | 90 | 95 | 3.4 |
| 1.3 | 6/0 | 0.50 | 74 | 62 | 3.4 |
| 1.4 | 5/1 | 0.25 | 95 | 84 | 3.4 |
| 1.5 | 5/1 | 0.50 | 88 | 81 | 3.5 |
| 1.6 | 2/1 | 0.25 | 95 | 89 | 3.5 |
| 1.7 | 2/1 | 0.50 | 50 | 59 | 3.4 |
| 1.8 | 1/1 | 0.25 | 95 | 81 | 3.4 |
| 1.9 | 1/1 | 0.50 | 12 | 59 | 3.3 |
| 1.10 | .5/1 | 0.25 | 92 | 91 | 3.4 |
| 1.11 | .5/1 | 0.50 | 16 | 9 | 3.4 |

Table 1 footnotes:
[1]Peel Test: 3M "Scotch" ® brand pressure sensitive self-sticking tape is applied to a film strip and then removed by hand.

These data indicate that improved adhesion of the heterogeneous photoconductive layer to the conductive layer is improved when an all-polyester interlayer is replaced with a stress-dampening interlayer comprising a mixture of polyester with a high molecular weight bisphenol-A-polycarbonate. The improvement is especially evident with stressed films.

Optimum layer thickness appears to be about 0.5 microns; thinner layers do not appear to offer any adhesion improvement and thicker layers appear to deleteriously affect the photosensitivity of the element. The useful multiphase stress-dampening layers comprise a mixture of the polycarbonate with from about 10 to about 90% and preferably 25 to about 75% of the total polymer mixture being polyester.

Coatings containing only polyester or only polycarbonate were found to be inferior to those containing a multiphase polymeric interlayer comprised of a polyester/polycarbonate mixture, as demonstrated in Example 2.

EXAMPLE 2

In this Example, a polyester sublayer was evaluated against either a mixture of polyester and a high molecular weight bisphenol-A-polycarbonate or by the polycarbonate alone. Conventional emitter and transport layers were utilized in all of the samples. The data obtained are summarized in the following table:

TABLE 2

| Example I.D. Number | Interlayer Component | Interlayer Composition % polyester | % polycarbonate | Thickness (microns) | % Peel |
|---|---|---|---|---|---|
| 2.1 | polyester alone (control)[1] | 100 | 0 | 0.13 | 30 |
| 2.2 | " | 100 | 0 | 0.25 | 50 |
| 2.3 | " | 100 | 0 | 0.50 | 38 |
| 2.4 | " | 100 | 0 | 1.00 | 0 |
| 2.5 | polycarbonate alone[2] | 0 | 100 | 0.13 | 96 |
| 2.6 | " | 0 | 100 | 0.25 | 98 |
| 2.7 | " | 0 | 100 | 0.50 | 98 |
| 2.8 | " | 0 | 100 | 1.00 | 100 |
| 2.9 | polyester + polycarbonate | 50 | 50 | 0.13 | 68 |
| 2.10 | " | 50 | 50 | 0.25 | 25 |
| 2.11 | " | 50 | 50 | 0.50 | 0 |
| 2.12 | " | 50 | 50 | 1.00 | 0 |

Table 2 Footnotes
[1]The polyester inherent viscosity was >0.4 (typically about 0.7)
[2]The high molecular weight bisphenol-A-polycarbonate inherent viscosity was 2.0.

Judging from the effects of the polyester alone, and of the polycarbonate alone, it would have been expected that the addition of the polycarbonate to the polyester layer would have degraded the effect of the polyester layer used alone. Surprisingly, the combination of the polycarbonate and the polyester polymers actually significantly improved the results obtained.

The multilayered films which passed the above test were retested using more stringent conditions, wherein, before the actual adhesion test, the film samples were bent 180° to crack the photoconductive layer. The results obtained in this test were as follows:

TABLE 3

| Ex. ID Number | Interlayer % polyester | % polycarbonate | Thickness (microns) | Peel |
|---|---|---|---|---|
| 2.13 | 100 | 0 | 1.00 | 18.6 |
| 2.14 | 50 | 50 | 0.13 | 0 |
| 2.15 | 50 | 50 | 0.25 | 0 |
| 2.16 | 50 | 50 | 0.50 | 0 |
| 2.17 | 50 | 50 | 1.00 | 0 |

While the films containing the mixed polyester/polycarbonate layer exhibited adhesion, the Example 2.17 coating above exhibited poor cyclic stability illustrating that while thick layers may be utilized to improve adhesion, such improvement is offset by a decrease in sensitometric properties.

EXAMPLE 3

In this Example, the conventional polyester sublayer was overcoated with a separate interlayer of either the high molecular weight bisphenol-A-polycarbonate or a 60/40 (by weight) mixture of the polycarbonate and tri-p-tolylamine to determine the effect of the materials used as a "composite" sublayer. A standard charge generating layer was coated on the test sublayer and then overcoated with a transport layer. The charge generating layer and the transport layer are as described in U.S. Pat. No. 4,175,960. It was coated at a reduced thickness of 11.5 to 12 microns over the charge generation layer to maintain one entire multi-layer structure at a desired thickness of 18 microns. The following data were obtained:

TABLE 4

| Example I.D. No. | Interlayer Composition[1] | Interlayer thickness (microns) | % Peel Orig. | After 180° Bend |
|---|---|---|---|---|
| 3.1 | Polycarbonate | 0.5 | 0 | 6.2 |
| 3.2 | Polycarbonate | 1.0 | 0 | 0 |
| 3.3 | 60/40 Polycarbonate/$Ar_3N$ | 0.5 | 0 | 0 |
| 3.4 | 60/40 Polycarbonate/$Ar_3N$ | 1.0 | 0 | 0 |

Table 4 Footnotes:
[1]Polycarbonate = High molecular weight bisphenol-A-polycarbonate $Ar_3N$ = tri-p-tolylamine While the above films all exhibited improved adhesion, none of the films exhibited adequate regeneration in sensitometric testing. The experimental films could not be charged to as high an initial voltage as the control, and the voltage was not constant, decreasing by 60 to 150 volts during 9000 cycles. It was noted, however, that the polycarbonate overcoats which also contained tri-p-tolylamine were sensitometrically better than those with unadulterated polycarbonate.

EXAMPLE 4

The following list records the adhesive quality of a variety of polymers when coated between a nickel conductive layer and the photosensitive layer. The adhesion was tested by vigorously wrinkling a ten-inch length of sample of each film and subjectively classifying the adhesion as "good," "marginal" or "poor" on the basis of how much of the sensitized layer(s) is detached by the treatment. All of the polymers tested were obtained from Aldrich Chemical except for the control polyester (which was as described in Ex. 1 above). The sensitized layer (11 microns) was a mixture of 68% poly [tetramethylene-co-1,4-cyclohexanedimethylene-N,N-bis(4-hydrocinnamate)aniline] 30% polycarbonate (purchased commercially as "Lexan 145" from General Electric Co.) and 2% 4-(p-dimethylaminophenyl)-2,6-diphenylthiapyrylium hexafluorophosphate.

TABLE 5

| Polymer Subs | Solvent* | Sub Layer Adhesion** 0.15μ | 1.5μ |
|---|---|---|---|
| Control Polyester | DCM | + | + |
| Phenoxy resin | DCM | + | + |
| Poly(vinyl butyral) | DCM | + | + |
| " | MEK | + | + |
| Methyl vinyl ether - maleic anhydride | MEK | + | + |
| Styrene - maleic anhydride | MEK | + | + |
| Poly(vinyl pyrrolidone) | DCM | + | + |
| N-vinyl pyrrolidone - vinyl acetate | DCM | + | + |
| " | MEK | + | + |
| Butyl methacrylate-isobutyl methacrylate | MEK | + | + |
| " | DCM | 0 | 0 |
| Poly(sulfone resin) | DCM | + | 0 |
| Vinyl alcohol-vinyl acetate | methyl acetate | 0 | + |
| Poly(methyl methacrylate) | DCM | + | − |
| " | MEK | 0 | + |
| Poly(caprolactone) | DCM | − | 0 |
| Poly(ethylene glycol) | DCM | − | − |
| Poly(chloroprene) | toluene | (a) | (b) |
| Ethyl cellulose | DCM | (c) | − |
| Octadecyl vinyl ether - maleic anhydride | toluene | (a) | − |
| Ethylene - vinyl acetate | toluene | (a) | − |

*DCM = dichloromethane
MEK = methyl ethyl ketone
**+ = good adhesion
0 = marginal adhesion
− = poor adhesion
(a) Did not coat, based on appearance of thicker coating
(b) Not sensitized, sub adhered poorly to conductive layer
(c) Would not coat well at thinner coverage Interlayers of these polymers do not adhere as well as the polymer mixtures of this invention.

While the "mixed-subs" of the foregoing examples are commonly coated from organic solvents, they may also be coated from aqueous dispersions in order to avoid any deleterious effect on other organic solvent-soluble layers in the element.

The charge generating layer coated over the adhesive layer(s) can vary but it is believed that the most significant improvements are noted with heterogenous photoconductive layers. The adhesive interlayers of this invention may be coated over a great variety of conducting layers but are believed to be especially useful with those prepared by the vacuum deposition of metals. If desired, the interlayers of this invention may contain additives such as coating aids, photoconductors, sensitizers, etc.

The foregoing specification is intended as illustrative and is not be taken as limited. Still other variations within the spirit and the scope of the invention are possible and will readily present themselves to those skilled in the art.

We claim:

1. A photoconductive element that comprises an electrically conductive layer; an interlayer that comprises a mixture of at least one polyester and at least one polycarbonate; and a charge generation layer that has a discontinuous phase comprising at least one polymer having an alkylidene diarylene group in a recurring unit and at least one thiapyrylium-dye salt.

2. The photoconductor element of claim 1 wherein said polyester has an inherent viscosity in the range of about 0.4 to about 0.8 measured as a 0.5 g/dL solution in 1:1 phenol:chlorobenzene at 25° C.

3. The photoconductor element of claim 1 wherein said polycarbonate has an intrinsic viscosity in the range of about 1.2 to about 2.0 measured as a 0.25 g/dL solution in dichloromethane at 25° C.

4. The photoconductor element of claim 1 wherein said interlayer has a thickness in the range of about 0.1 to 1 micron.

5. The photoconductor element of claim 4 wherein said interlayer has a thickness is in the range of about 0.4 to 0.6 micron.

6. The photoconductor element of claim 4 wherein said interlayer has a thickness of about 0.5 micron.

* * * * *